US008814773B2

(12) United States Patent
Chase et al.

(10) Patent No.: US 8,814,773 B2
(45) Date of Patent: Aug. 26, 2014

(54) BOOKLET MAKER WITH CREASE ROLLER

(75) Inventors: Thomas E. Chase, Letchworth Garden City (GB); Stephen May, Stotfold (GB); Jeffrey W. Ryan, Knebworth (GB); Ian A. Parks, St. Albans (GB); Justin Chase, Sandy (GB)

(73) Assignee: Xerox Corporation, Norwalk, CT (US)

( * ) Notice: Subject to any disclaimer, the term of this patent is extended or adjusted under 35 U.S.C. 154(b) by 869 days.

(21) Appl. No.: 12/475,177

(22) Filed: May 29, 2009

(65) Prior Publication Data

US 2010/0304946 A1 Dec. 2, 2010

(51) Int. Cl.
*B31F 1/10* (2006.01)

(52) U.S. Cl.
USPC ..... 493/442; 493/424; 493/434

(58) Field of Classification Search
USPC ..... 493/442, 424, 427, 434, 435, 454; 412/1, 4, 8, 9, 22, 37
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,088,904 | A * | 8/1937 | Grammer | 281/15.1 |
| 4,875,668 | A * | 10/1989 | Spyra | 270/45 |
| 5,221,112 | A * | 6/1993 | Holmberg | 281/21.1 |
| 5,871,323 | A * | 2/1999 | Clark | 412/4 |
| 6,692,208 | B1 * | 2/2004 | Watkiss et al. | 412/1 |
| 7,431,273 | B2 * | 10/2008 | Kamiya et al. | 270/37 |
| 7,431,274 | B2 * | 10/2008 | Kushida et al. | 270/37 |
| 2005/0191154 | A1 | 9/2005 | Fujimoto et al. | |
| 2006/0263174 | A1 | 11/2006 | Oikawa et al. | |

FOREIGN PATENT DOCUMENTS

EP 1386874 A1 2/2004

* cited by examiner

*Primary Examiner* — Sameh H. Tawfik

(57) ABSTRACT

A booklet maker having a first crease device forming a folded edge on a set of sheets. A second crease device is disposed downstream along a booklet processing path from the first crease device. The second crease device includes an edge engaging mechanism translatable in a direction transverse to the path of booklet travel. The edge engaging mechanism is compressively engagable with the folded edge of a booklet for forming a crease in the booklet.

10 Claims, 7 Drawing Sheets

BOOKLET MAKER WITH CREASE ROLLER

BACKGROUND

1. Technical Field

The present disclosure relates to automated booklet makers, in which sheets forming a booklet are folded upon action of crease rollers.

2. Brief Discussion of Related Art

Booklet makers are well-known devices for forming folded booklets which are stapled or otherwise joined along the crease thereof. It is becoming common to include booklet makers in conjunction with office-range printers. The word "printer" as used herein encompasses any apparatus, such as a copier, digital copier, bookmaking machine, facsimile machine, multifunction machine, etc. which performs a print outputting function for any purpose. In basic form, a booklet maker includes a slot for accumulating processed sheets, as would be produced by a printer. The accumulated sheets, forming the pages of a booklet, are positioned within the stack so that a stapler mechanism and complementary anvil can staple the stack precisely along the intended crease line. The creased and stapled sheet sets are then pushed, by a crease blade, completely through crease rollers to form the final main fold in the finished booklet. The finished booklets are then accumulated in a tray downstream of the crease rollers.

In order to form a tight crease, after the booklet is initially folded by a first set of crease rollers, the entire booklet may be passed through a second set of crease rollers. The second set of crease rollers are typically held together under significant tension by a biasing device so that a tight, high quality finish crease is formed along the edge or spine of the booklet. This roller pressure, which acts over the entire booklet, has a tendency to cause image transfers between the pages. The quality of the images is therefore compromised.

Accordingly it would be desirable to provide a booklet maker having a high quality tight crease along the spine without distorting the images.

SUMMARY

According to aspects illustrated herein, there is provided a booklet maker having a first crease device forming a folded edge on a set of sheets. A second crease device is disposed downstream along a booklet processing path from the first crease device. The second crease device includes an edge engaging mechanism translatable in a direction transverse to the path of booklet travel. The edge engaging mechanism is compressively engagable with the folded edge of a booklet for forming a crease in the booklet.

According to other aspects illustrated herein, there is provided a booklet maker creasing module including a pair of longitudinally aligned rollers which form a nip there-between. A crease blade disposed adjacent to the pair of rollers. The crease blade is movable toward the nip to urge a booklet into the pair of rollers. The pair of rollers forms a folded edge in the booklet. An edge roller and a backing surface cooperate to form a crease in the booklet. The edge roller and the backing surface are disposed downstream along a booklet processing path from the pair of rollers.

According to further aspects illustrated herein, there is provided a method of forming a booklet including:

forming a folded edge in a set of sheets using a first creasing device including a pair of longitudinally aligned rollers;

transporting the set of sheets along a processing path to a second creasing device including an edge roller; and moving the edge roller along the length of folded edge thereby forming a crease in the set of sheets.

DETAILED DESCRIPTION

Exemplary embodiments include a booklet maker including crease rollers for forming booklets. The booklet maker can include a first set of crease rollers for bending booklet sheets and making an initial crease. A second crease device travels along the initial crease forming a tight crease on the folded edge.

In some embodiments, the second crease device includes an edge roller which extends over the folded edge of the booklets and imparts pressure for forming the tight crease only to the edge of the booklet. In other embodiments, a guide is provided which supports the folded edge of the booklet when the edge roller extends over the folded edge. The guide may be moved out of a booklet processing path to permit the booklet to continue through the booklet maker.

As used herein, "booklet maker" refers to a device that operates on substrate media, such as sheets of paper, to form a booklet of folded sheets secured together.

As used herein, "crease device" refers a device which engages sheets of media and forms a bend, fold or crease therein.

As used herein, "edge engaging mechanism" refers to a device which engages the edge of a folded substrate media for forming a bend, fold or crease.

As used herein, "crease roller" refers to a rotating longitudinally extending device for engaging substrate media to form a bend, fold, or crease therein.

As used herein, "edge roller" refers to a rotating member that is engagable in a rolling manner with the folded edge of a booklet to form a crease therein.

As used herein, "nip" refers to a position between a roller and a surface or between two rollers.

As used herein, "crease blade" refers to a member engagable with substrate media to assist in forming a bend, fold, or crease therein.

As used herein, "booklet processing path" refers to the path along which a booklet travels through a booklet maker or other processing device.

As used herein "backing surface" refers to a support, stationary or movable, for the folded edge of a booklet during operation by an edge roller.

Figure 1:
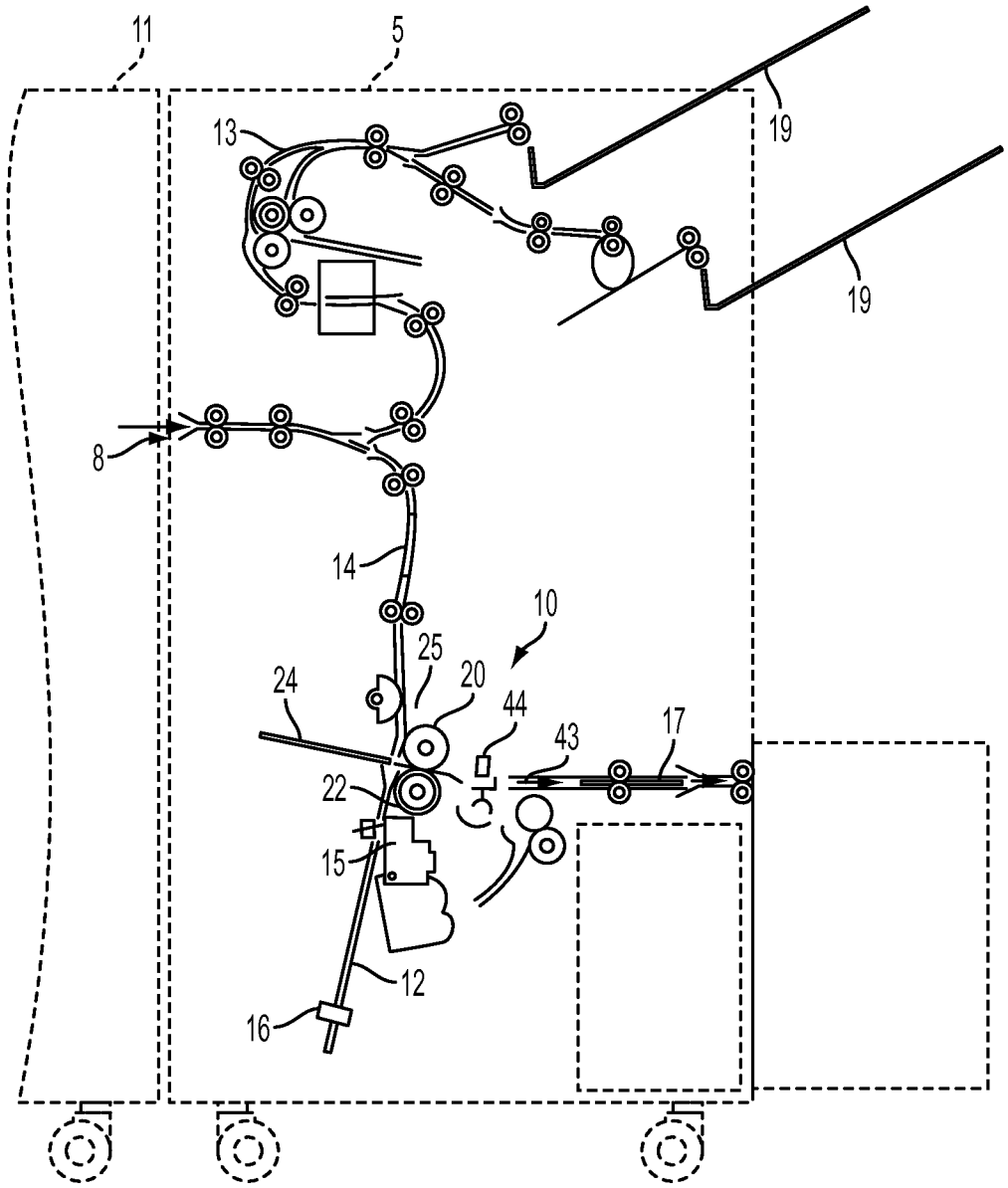
FIG. 1 is a simplified elevational side view of a finisher module.

FIG. 1 is a simplified elevational side view of a finisher module, generally indicated as 5. The finisher module 5 includes a booklet maker 10, as may be used with an office-range printer or other printing machine. Printed sheets from the printer 11 are accepted in an entry port 8. Depending on the specific design of finisher module 5, there may be numerous paths such as 13 and numerous output trays 19 for print sheets, corresponding to different desired actions, such as stapling, hole-punching and C- or Z-folding. It is to be understood that the various rollers and other devices which contact and handle sheets within finisher module 5 are driven by various motors, solenoids and other electromechanical devices (not shown), under a control system, such as including a microprocessor (not shown), within the finisher module 5, printer 11, or elsewhere, in a manner generally familiar in the art. For present purposes what is of interest is the booklet maker generally indicated as 10.

Booklet maker 10 defines a "slot" which is here indicated as 12. Slot 12 accumulates processed sheets 14 from the printer 11 forming a sheet set. The sheets may be signature sheets (sheets each having four page images thereon, for eventual folding into pages of the booklet). Each sheet is held within slot 12. There is provided at the bottom of slot 12 an elevator 16, which forms the "floor" of the slot 12 on which the edges of the accumulating sheets rest before they are further processed. In order to receive the sheets from the printer, the elevator 16 is placed at different locations along slot 12 depending on the size of the incoming sheets. The elevator 16 also moves the sheets to different locations so they may be processed, such as stapled and creased to form a booklet.

As printed sheets are output from printer 11, elevator 16 is positioned so that the trailing edge of the sheets 14 (which would be at the top of slot 12) are disposed above a first crease device which may include a first pair of crease rollers 20, 22. When all of the necessary sheets to form a desired booklet are accumulated in slot 12, elevator 16 is moved from its first position to a second position where the midpoint of the sheets are adjacent the stapler 15. Stapler 15 is activated to place one or more staples along the midpoint of the sheets, where the booklet will eventually be folded.

Figure 2:
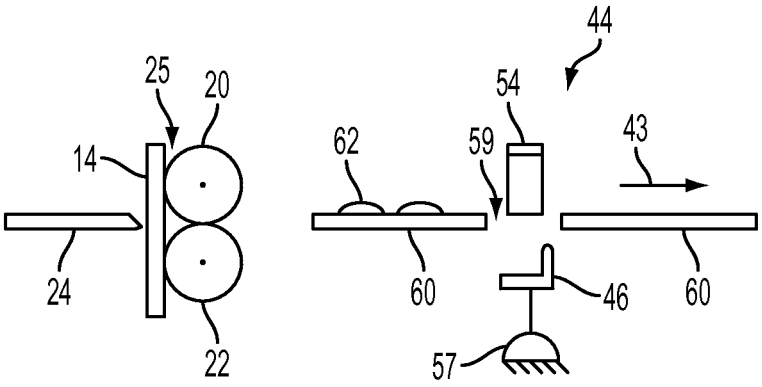
FIG. 2 is a schematic side view of a booklet maker including a first and second crease device.
Figure 3:
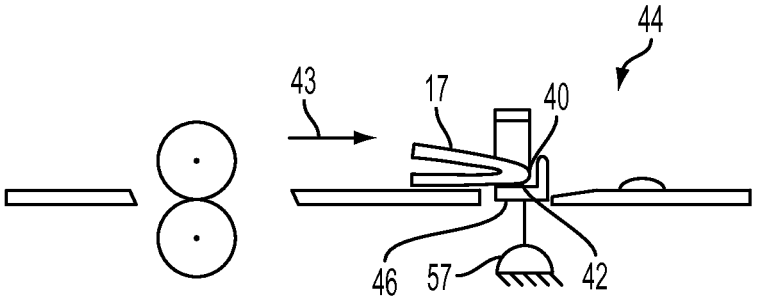
FIG. 3 is a schematic side view of the booklet maker of FIG. 2 operating on a booklet.

With reference to FIGS. 2 and 3, after the stapling is performed, elevator 16 is moved from its second position to a third position, thereby moving the sheets 14 to a creasing position. In this position, the midpoint of the stack of sheets 14 are adjacent a crease blade 24 and the first crease device 25 which includes the set of crease rollers 20 and 22. The action of blade 24 and crease rollers 20 and 22 performs the initial folding of the sheets into a booklet 17. Crease rollers 20 and 22 are longitudinally aligned with each other in a parallel relationship and supported at their ends to permit rotary motion. The crease rollers 20 and 22 may be operatively connected to a drive mechanism (not shown) which selectively rotates the crease rollers to draw in the sheets. The entire booklet travels between crease rollers 20 and 22.

The crease rollers 20 and 22 may be translatable with respect to each other and are biased toward an initial position. The nip pressure between the crease roller 20 and 22 may be relatively light. The crease rollers may even be spaced from each other in an initial position. Therefore, the initial crease formed by the crease rollers 20 and 22 is a generally loose preliminary crease which creates a folded edge 40, forming a booklet spine 42. The initial crease, while creating a folded or bent edge, does not impart a tight finish crease to the booklets 17. Accordingly, the images imparted on the sheets are not distorted during the forming of the initial crease.

Figure 4:
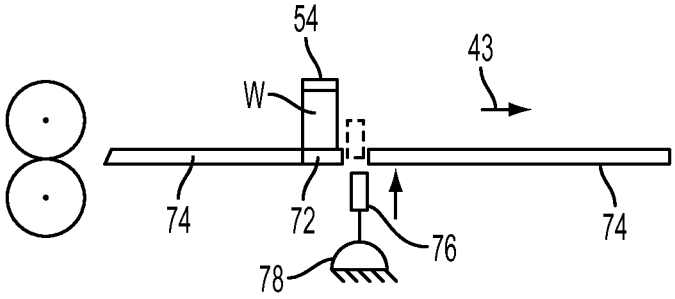
FIG. 4 is a schematic side view of the booklet maker depicting an alternative guide moved out of a booklet processing path.
Figure 5:
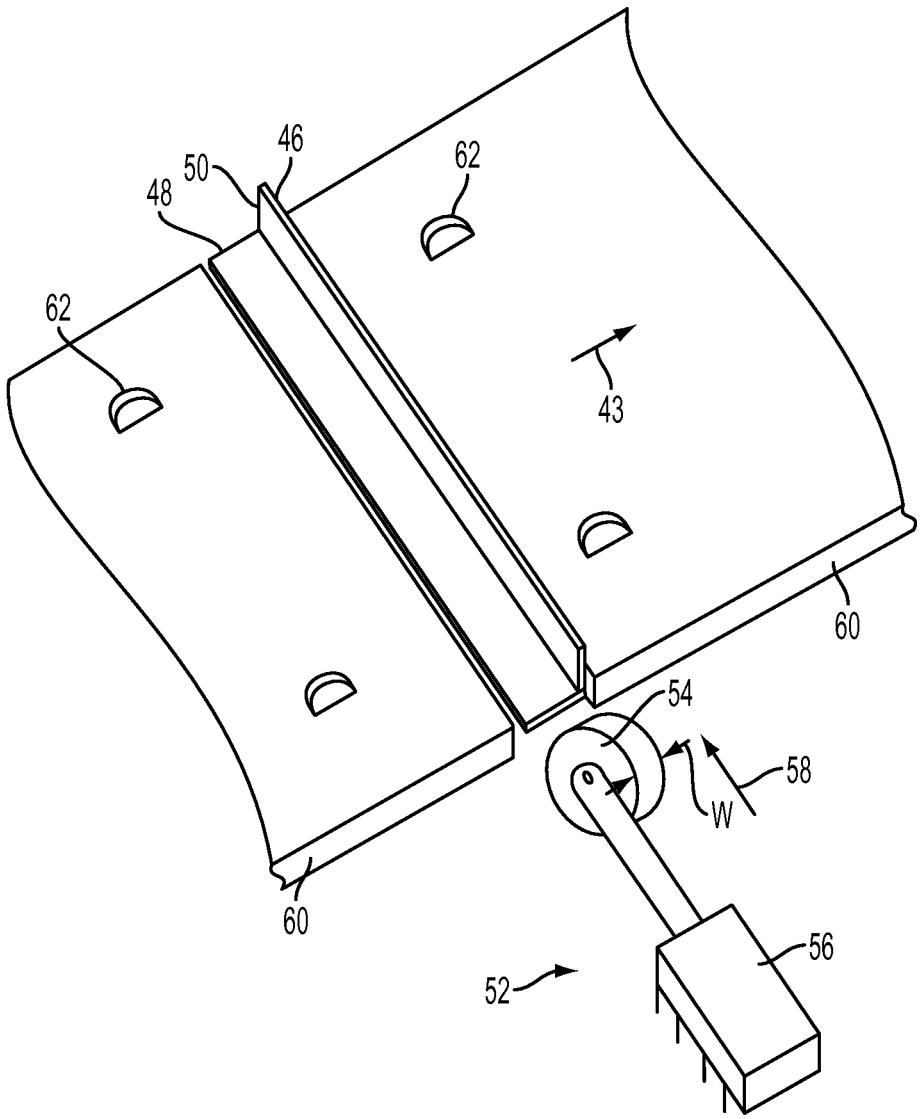
FIG. 5 is a perspective view of the second crease device.

With reference to FIGS. 3-5, in order to complete the creasing of the booklet to form a tight finish crease, the booklet 17 is transported out of rollers 20 and 22, along a booklet processing path 43, which is the path of booklet travel, through the booklet maker. The booklet 17 then enters a second crease device 44 which applies a tight crease to the booklet. The second crease device 44 may act on a portion of the booklet 17, namely the folded edge 40. The second crease device 44 may include a guide 46 and an edge engaging mechanism 52. The guide 46 may properly position the booklet 17 and provide support thereto when the tight crease is formed. Guide 46 may have a generally L-shaped cross-section having a base 48 and an upwardly extending wall 50. Base 48 may form a backing surface for supporting the spine 42 during the tight creasing operation. The wall 50 extends transversely across the booklet processing path 43 and acts as a stop against which the booklet spine 42 abuts in order to ensure it is in proper position for the tight creasing operation.

Figure 6:
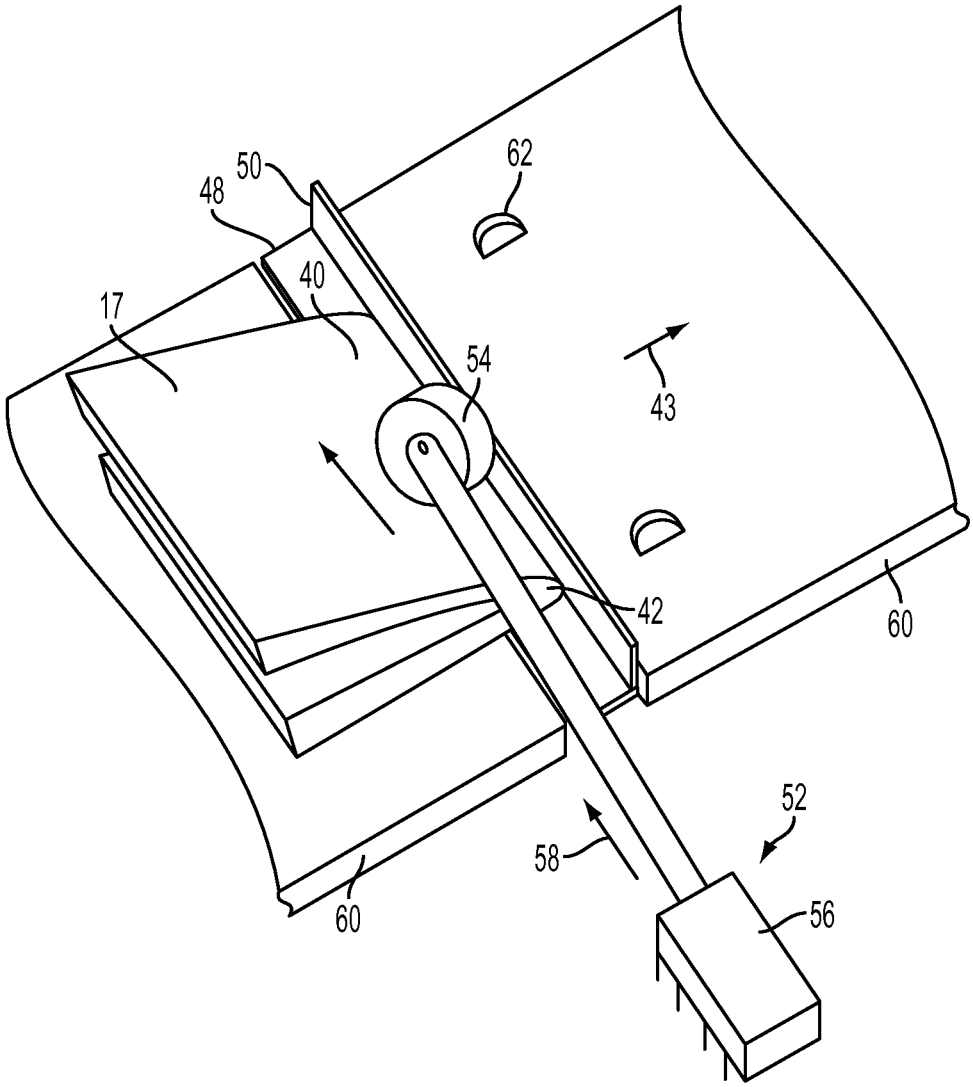
FIG. 6 is a perspective view of the second crease device operating on a booklet.

With reference to FIGS. 5 and 6, edge engaging mechanism 52 cooperates with the guide 46 to form a tight crease on the booklet 17. The edge engaging mechanism 52 may include an edge roller 54 and a drive 56 that translates the edge roller in a direction 58 substantially transverse to the path of the booklet travel 43. The edge roller 54 is disposed above the guide's base 48 and travels across the guide's surface. When a booklet 17 is positioned in the guide as shown in FIG. 6, the drive 56 moves the roller 54 over the entire length of the booklet's spine 42. The edge roller 54 compressively engages the folded edge 40 such that the edge is compressed between the edge roller 54 and the guide's base 48, thereby forming the tight crease. The edge roller 54 may be biased downward toward the guide so that a compressive force is exerted on the fold in order to help create the tight finish crease. The edge roller drive 56 may move the edge roller 54 from an initial position in a direction from one end of the spine to the other and then reverse the edge roller direction so that the roller returns to its initial position. Accordingly, the edge roller 54 may engage the folded edge 40 twice. Alternatively, the drive 56 may move the roller 54 from one end of the spine 42 to the other and then wait for the next booklet to be moved into position against the guide. The edge roller 54 may then be driven to the initial position, thereby rolling over and creasing the next booklet. Therefore, each booklet 17 would be engaged once by the edge roller 54 to form the tight crease.

The edge roller 54 may have a width such that it only engages the booklet 17 along the folded edge 40. For example, a width of about 25mm may be used, although other width could be employed. Accordingly, unnecessary force is not placed on the remainder of the booklet, thereby avoiding unnecessary distortion of the images.

Guide 46 may be movably mounted such that it can move in and out of the booklet processing path 43. When a booklet 17 engages the guide and the spine 42 abuts the wall 50, the travel of the booklet 17 may pause momentarily in order to permit the tight creasing operation to take place. Once the roller 54 extends over the entire length of the spine and completes the tight crease, the guide 46 may move out of the path of travel and the finished booklet 17 may continue its travel through the booklet maker and finisher module.

As shown in FIGS. 2 and 3, guide 46 may be operably connected to a guide actuator 57. Guide actuator 57 may, for example, be an electromechanical device such as a solenoid or a pneumatic device. When activated, the guide actuator 57 may translate the guide 46 up and down within a slot 59 formed in a transport support 60. The transport support 60 may include a surface for supporting the booklets and transport elements 62 such as wheels which move the booklet 17 along the booklet processing path 43. The guide actuator 57 may be operably connected to a controller so that the movement of the guide 46 is coordinated with the travel of the booklets 17 moving out of the crease rollers 20 and 22.

Figure 7:
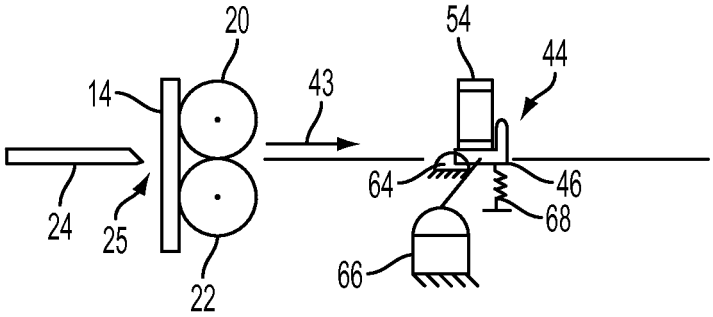
FIG. 7 is a schematic side view of the booklet maker showing a further alternative guide.
Figure 8:
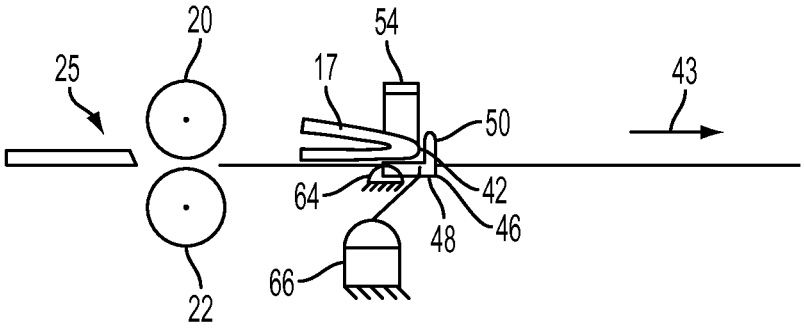
FIG. 8 is the booklet maker of FIG. 7 showing the second crease device operating on a booklet.
Figure 9:
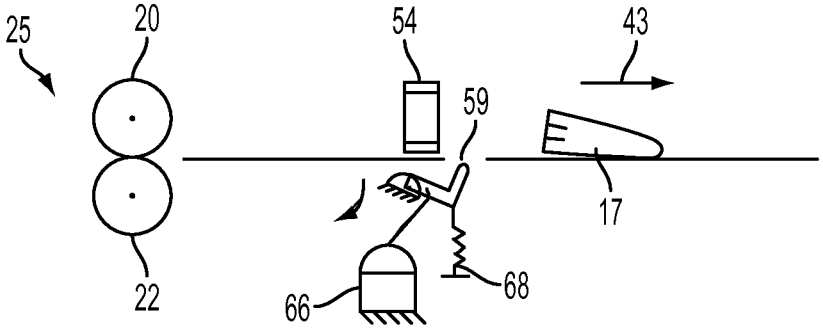
FIG. 9 is a schematic side view of the booklet maker of FIG. 7 showing a guide moved out of the booklet processing path.

Alternatively, as shown in FIGS. 7-9, guide 46 may be hingedly attached to a structural member 64 so that the guide 54 can pivot in and out of slot 58 thereby selectively interrupting the path of travel 43. A guide actuator 66 operably connected to the guide 46 may be selectively activated to move into a creasing position shown in FIGS. 7 and 8. After a booklet 17 is creased, the guide actuator 66 moves the guide to a retracted position as shown in FIG. 9. Alternatively, the guide 46 may be operably connected to a biasing device 68 (FIGS. 7 and 9) which urges the guide 46 toward the retracted position. Accordingly, when the guide actuator is deactivated, the guide returns to the retracted position.

With reference to FIG. 4, an additional alternative configuration of guide is shown. Guide 70 may be formed such that a base surface 72 is connected to or part of a transport support 74. A wall 76, operably connected to a guide actuator 78, moves in and out of the booklet path 43. Accordingly, the base surface 72 remains stationary and cooperates with the edge roller 54 to form the tight crease in the booklet 17. The wall 76 extends up into the booklet processing path 43 to form the abutment surface to properly align the booklet spine and edge when the crease is formed, the wall 76 may retract below the transport support 74 to permit the creased booklet to move along the booklet processing path 43.

Figure 10:
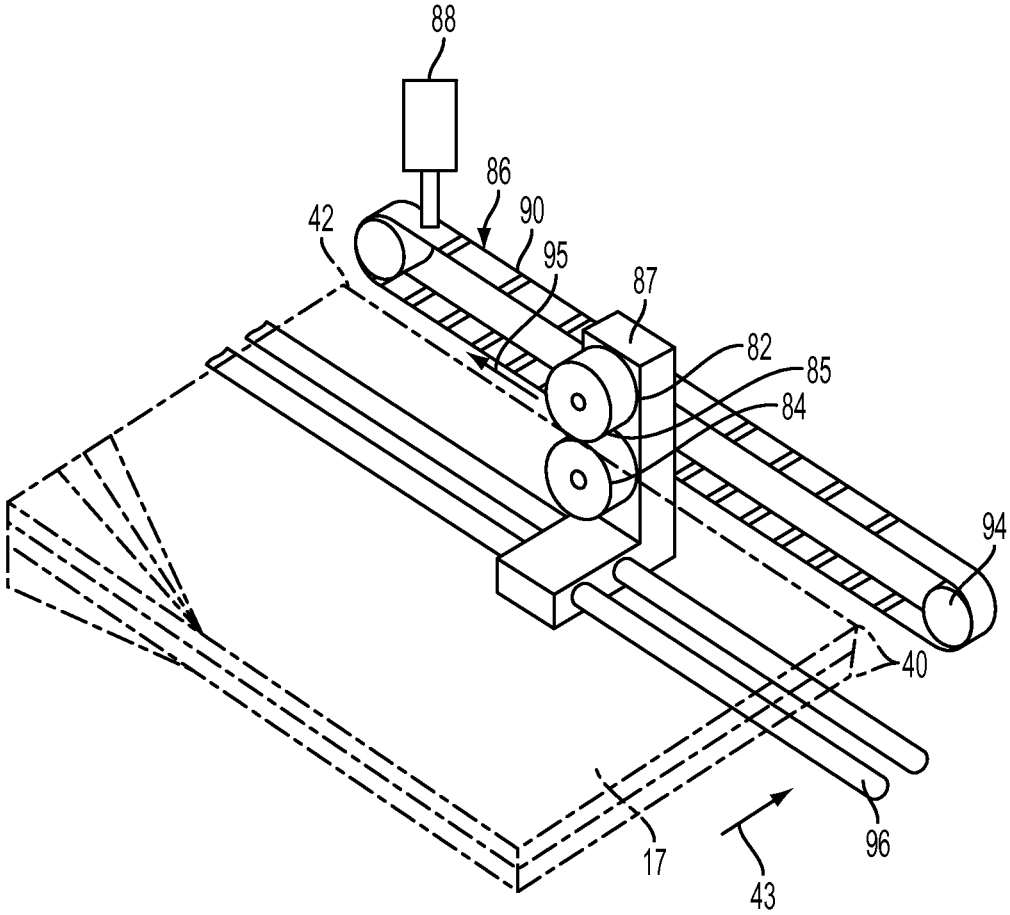
FIG. 10 is a perspective view of an alternative second creasing device operating on a booklet shown in phantom.

With reference to FIG. 10, still a further configuration may include a second crease device having an edge engaging mechanism including a first and second edge roller 82 and 84, respectively, working in cooperation to form a tight crease along the booklet folded edge 40. The edge rollers 82 and 84 themselves provide the function of a guide as the booklet folded edge 40 is compressed between the two edge rollers as they travel along the booklet spine 42. First edge roller 82 may be disposed above the booklet 17 and second edge roller 84 may be positioned below the booklet 17. The first and second edge rollers 82 and 84 may be aligned opposed from each other forming nip 85. The rollers 82 and 84 may be operable connected to a drive mechanism 86. Drive mechanism 86 may include carriage 87 on which the rollers 82 and 84 are supported. Carriage 87 may have an L-shaped configuration, although other configurations are contemplated. A motor 88 is operably engagable with the carriage via a transmission device such as a toothed-belt 90 secured to the carriage 87. An idler pulley 94 may be included to support the belt 90. One or both of the edge rollers 82 and 84 may be spring loaded toward each other to provide a variable nip force and form the tight crease. Carriage 87 may be supported on linear guide rods 96 that extend along a direction of carriage travel 95. When the booklet is in a predetermined position, the travel of the booklet 17 may be temporarily paused. The drive motor 88 may then be energized thereby moving the first and second edge rollers 82 and 84 from an initial position, in a direction transverse to the booklet processing path 43, along the length of the spine 42. The folded edge 40 is thereby imparted with a tight crease. The two edge rollers 82 and 84 working together provide a rolling function and a backing surface function, to both crease and support the folded edge 40. When the first and second rollers extend over the entire length of the spine. After the creased is completed, the creased booklet 17 may be moved along the path of booklet travel 43.

Figure 11:
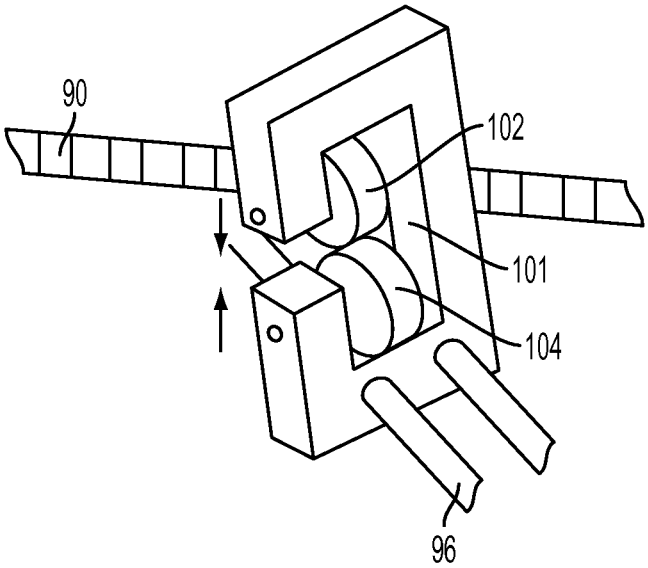
FIG. 11 is a partial perspective view of another alternative second creasing device showing a booklet in phantom.

An alternative of the carriage is shown in FIG. 11. Carriage 100 may have a C-shaped profile having an inner space 101. First and second edge rollers, 102 and 104 respectively, are rotatably secured to the carriage 100 within the inner space 101 One or both of the edge rollers may be biased toward the other to provide a variable nip force. The carriage 100 may be traversed along the spine 42 by a drive mechanism (not shown) in a manner described above with respect to the carriage 87 of FIG. 10. Them folded edge 40 is thereby imparted with a tight finish crease.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A booklet maker comprising:

a first crease device forming a folded edge on a set of sheets; and a second crease device disposed downstream along a booklet processing path from the first crease device, the second crease device including an edge engaging mechanism translatable in a direction transverse to the booklet processing path, the edge engaging mechanism compressively engagable with the folded edge of a booklet for forming a crease in the set of sheets to form a booklet, the edge engaging mechanism including a first edge roller, and the second crease device including a guide having a longitudinal extent extending along a length of travel of the first edge roller, the guide supporting the folded edge of the booklet when engaged by the first edge roller along the length of travel, and the guide including a stop extending upwardly therefrom, the stop temporarily interrupting travel of the booklet and aligning the folded edge of the booklet during operation of the first edge roller, and wherein the first edge roller and the guide compress the folded edge there between as the edge engaging mechanism translates along a length of the folded edge to form a crease.

2. The booklet maker of claim 1, wherein the guide is selectively movable in and out of the booklet processing path.

3. The booklet maker of claim 2, wherein the guide translates in a linear direction in and out of the booklet processing path.

4. The booklet maker of claim 1, wherein the guide includes a base surface disposed opposed from the edge roller, the base surface supporting the folded edge when the first edge roller extends thereover.

5. The booklet maker of claim 4, wherein the stop extends from the base surface toward the booklet processing path.

6. The booklet maker of claim 4, wherein the stop selectively moves relative to the base surface in and out of the booklet processing path.

7. The booklet maker of claim 1, wherein the edge engaging mechanism is sized to engage substantially only the folded edge of the booklet.

8. The booklet maker of claim 1, wherein the first crease device includes a nip formed between a pair of rollers and a crease blade movably disposed adjacent the nip, the crease blade being movable toward the nip to urge the set of sheets into the nip to form the folded edge.

9. The booklet maker of claim 1, wherein the guide is disposed on one side of the folded edge and the first edge roller is disposed on an opposite side of the folded edge, and the first edge roller and the guide cooperate with each other when the first edge roller of the edge engaging mechanism translates along an entire length of the folded edge to form a crease therein.

10. The booklet maker of claim 1, wherein the stop is disposed in the booklet processing path while the edge engaging mechanism translates along a length of the folded edge.

* * * * *